US006679749B2

(12) United States Patent
Yu

(10) Patent No.: US 6,679,749 B2
(45) **Date of Patent: *Jan. 20, 2004**

(54) TELESCOPIC DOLL STRUCTURE

(76) Inventor: Jui Hsia Yu, 2F, No. 294, Sec. 1, Dun Hua S. Rd., Taipei 106 (TW)

( * ) Notice: Subject to any disclaimer, the term of this patent is extended or adjusted under 35 U.S.C. 154(b) by 0 days.

This patent is subject to a terminal disclaimer.

(21) Appl. No.: 10/104,796

(22) Filed: Mar. 21, 2002

(65) Prior Publication Data

US 2003/0181125 A1 Sep. 25, 2003

(51) Int. Cl.[7] ..... A63H 33/00

(52) U.S. Cl. ..... 446/71; 446/314; 446/320; 446/330; 446/366

(58) Field of Search ..... 446/71, 311, 312, 446/314, 315, 320, 331, 330, 365, 366, 378, 489, 478

(56) References Cited

U.S. PATENT DOCUMENTS 2,741,870 A * 4/1956 Lang
3,442,045 A * 5/1969 Green
5,310,380 A * 5/1994 Levy et al. ..... 446/489
6,491,567 B2 * 12/2002 Chan ..... 446/478

* cited by examiner

*Primary Examiner*—Derris H. Banks
*Assistant Examiner*—Ali F Abdelwahed
(74) *Attorney, Agent, or Firm*—Rosenberg, Klein & Lee

(57) ABSTRACT

A telescopic doll structure comprises a base, a top stage, and a telescopic rack. The telescopic rack is composed of at least two hollow pipes with one pipe being able to be straightly shrunk into another pipe. The base is assembled to one end of one pipe and the top stage is assembled to one end of another pipe. At least one clamping unit is used to clamp the at least two hollow pipes when they are expanded. A figure is arranged on the top stage to enclose an exterior of the telescopic doll structure.

8 Claims, 12 Drawing Sheets

TELESCOPIC DOLL STRUCTURE

FIELD OF THE INVENTION

The present invention relates to a telescopic doll structure, especially to a telescopic doll structure, which can be shrunk for storage and expanded for using.

BACKGROUND OF THE INVENTION

Conventional dolls in human or animal shape generally have a fixed size. Therefore, the transportation and storage of these dolls with fixed sized present serious problems, especially for a large size doll.

China patent No. 2464405 discloses a toy with flexible size, which comprises a body, a resilient set, a positioning ring, and a seat. The body and the seat have an arbitrary shape for mimicking a human or animal. The resilient set comprises a supportive plate and hollow pipes with a tensile spring to provide flexible size to the toy. However, in the prior art toy with flexible size, the toy needs resilience to be set with the tensile spring. The resulting structure is therefore complicated and excessive in cost.

SUMMARY OF THE INVENTION

It is the object of the present invention to provide a telescopic doll structure, which can be shrunk for storage and expanded for using.

To achieve the above object, the present invention provides a telescopic doll structure comprising a base, a top stage, and a telescopic rack. The telescopic rack is composed of at least two hollow pipes with one pipe being able to be straightly shrunk, or retracted, into another pipe. The base is assembled to one end of one pipe and the top stage is assembled to one end of another pipe. At least one clamping unit is used to clamp the at least two hollow pipes when they are expanded. A figure is arranged on the top stage to enclose an exterior of the telescopic doll structure.

BRIEF DESCRIPTION OF THE DRAWINGS

The various objects and advantages of the present invention will be more readily understood from the following detailed description when read in conjunction with the appended drawings, in which.

DETAILED DESCRIPTION OF THE INVENTION

Figure 9:
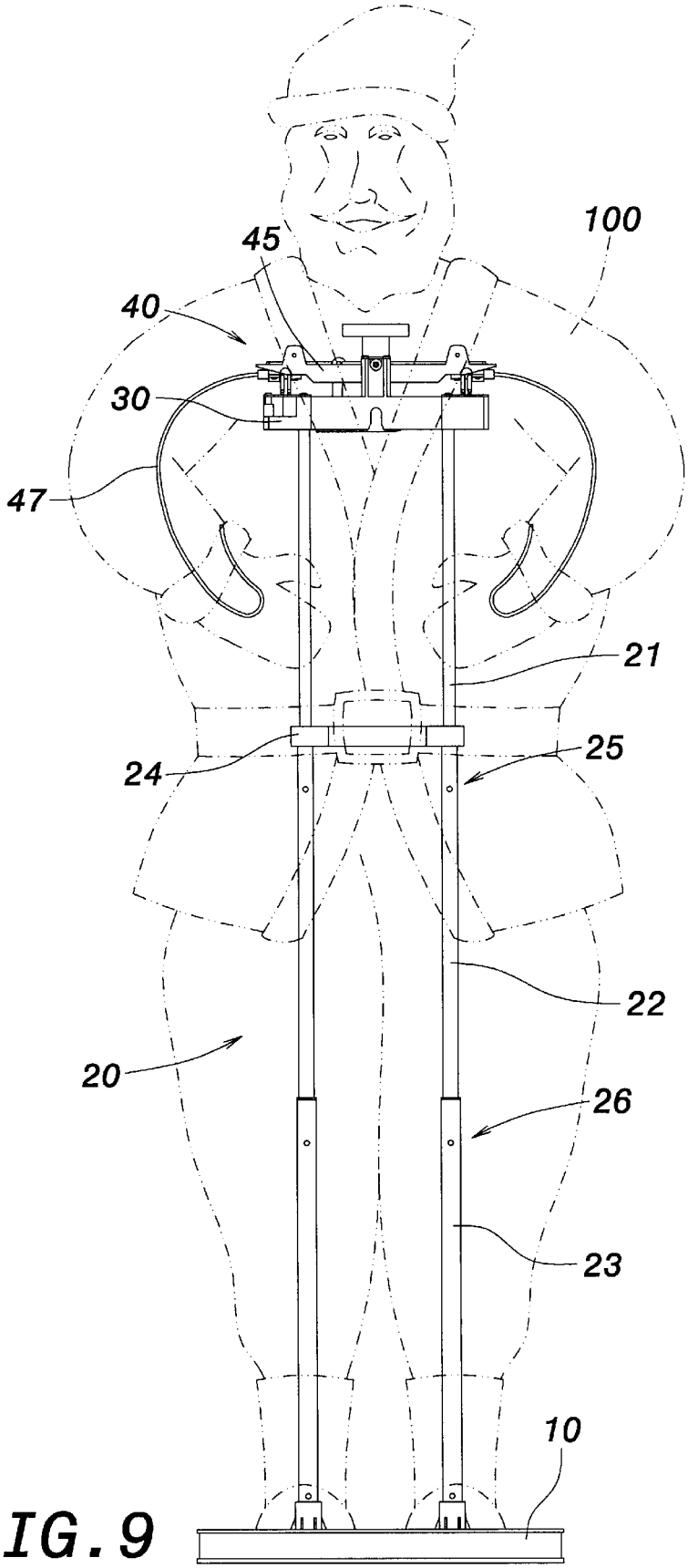
FIG. 9 shows the inventive telescopic doll structure combined with the figure.
Figure 10:
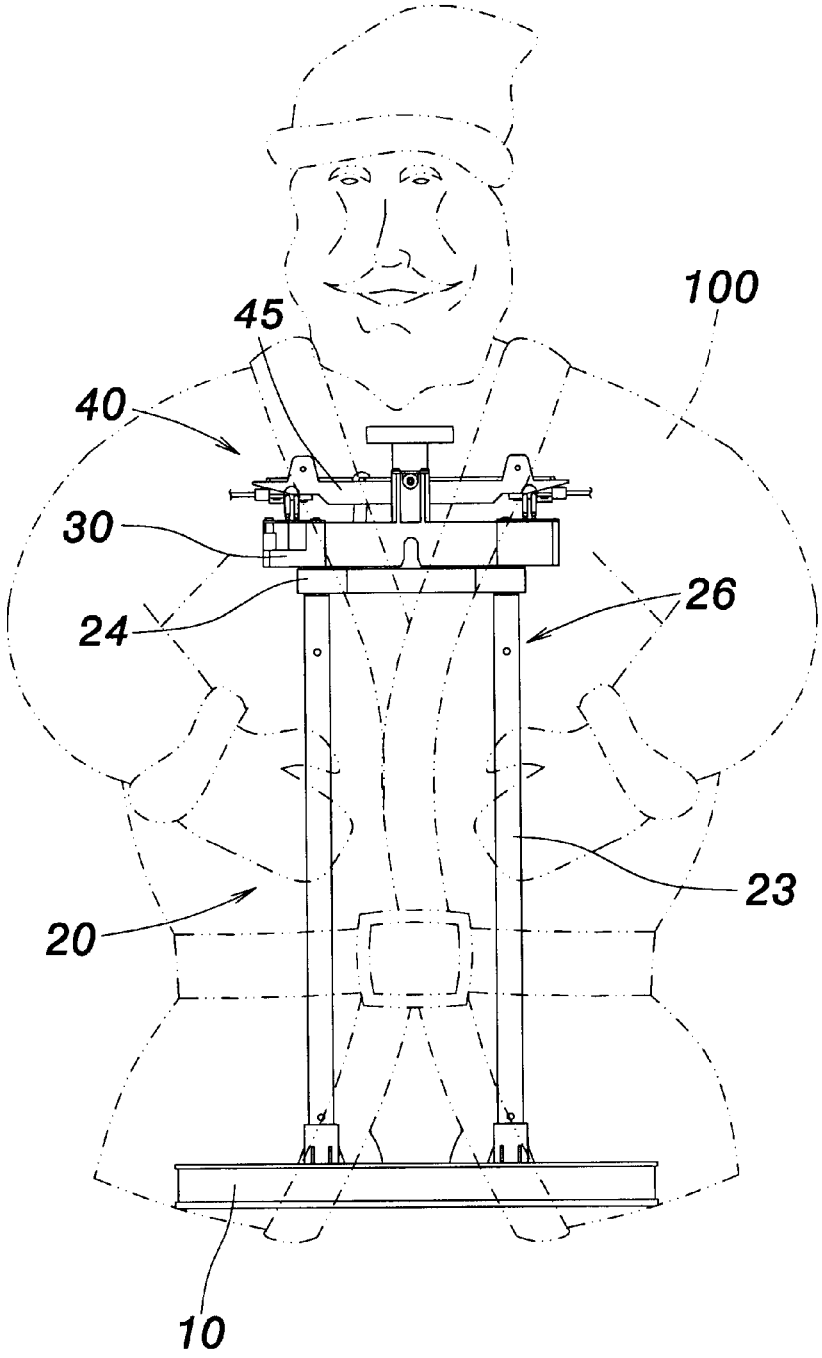
FIG. 10 shows the inventive telescopic doll structure combined with the figure in a shrunk state.

With reference to FIGS. 1 to 5, the present invention provides a telescopic doll structure comprising a base 10, a telescopic rack 20, a top stage 30 and a FIG. 100 (with reference to FIGS. 9 and 10). The base 10 is of a flat plate shape and can be placed on the ground for supporting the doll.

The telescopic rack 20 is composed of hollow pipes with two segments or three segments. In the described embodiment, the telescopic rack 20 is composed of hollow pipes with three segments, i.e. a top pipe 21, a middle pipe 22 and a bottom pipe 23. The top pipe 21 can be straightly shrunk into the middle pipe 22, and the middle pipe 22 can be straightly shrunk into the bottom pipe 23. Moreover, the base 10 is assembled to a lower end of the bottom pipe 23, and the top stage 30 is assembled to an upper end of the top pipe 21.

Figure 4:
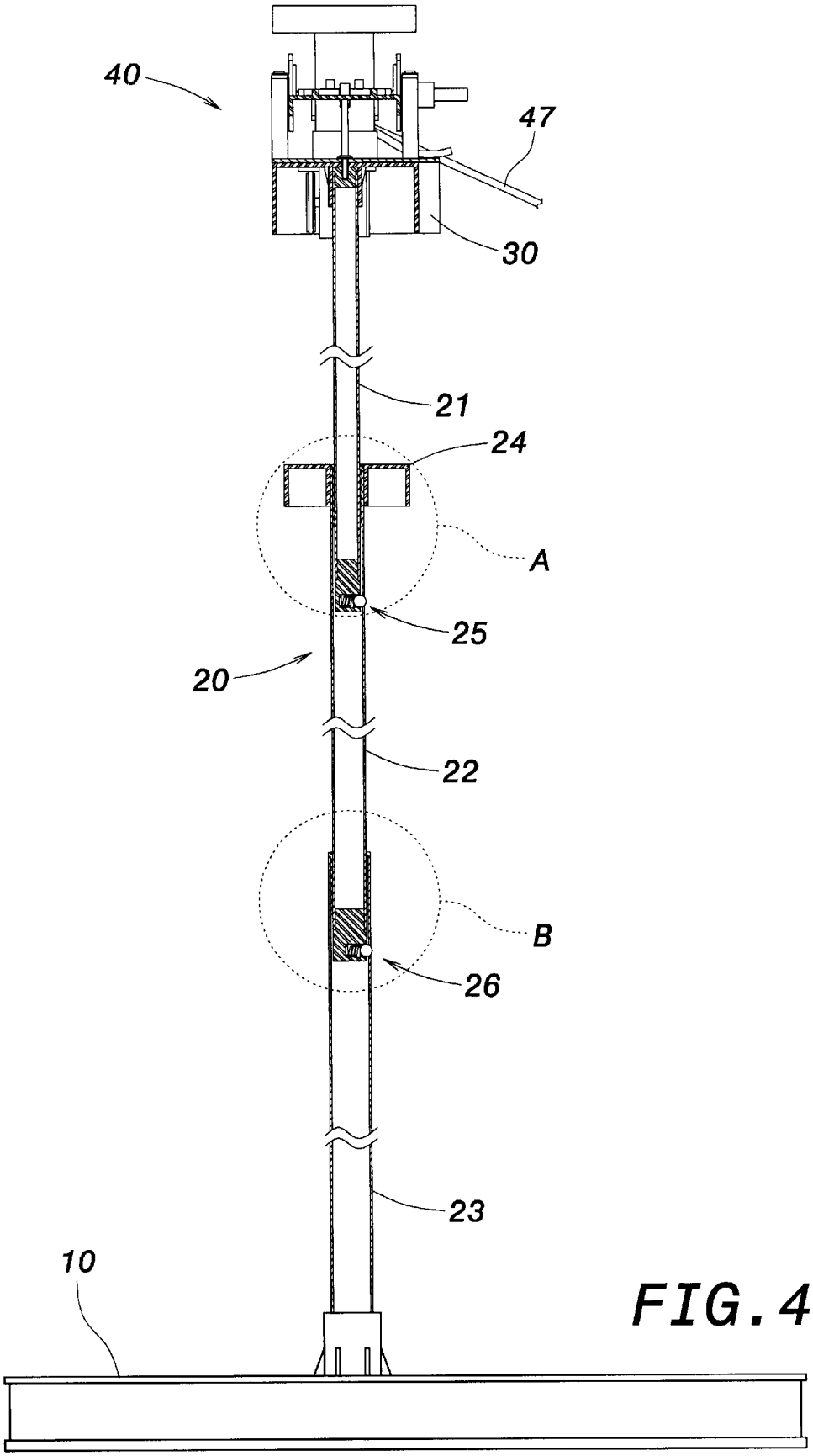
FIG. 4 shows a sectional view of the inventive telescopic doll structure with the figure being removed.
Figure 4A:
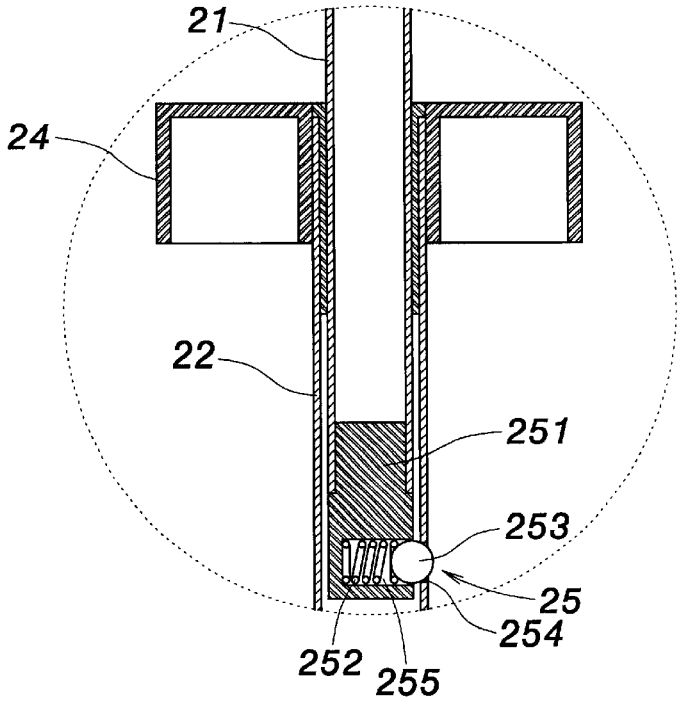
FIG. 4A shows an enlarged view of part A in FIG. 4.

The middle pipe 22 is connected to a connection stage 24 on an upper end thereof. A first clamping unit 25 is provided between the top pipe 21 and the middle pipe 22 and comprises a fixed stage 251, a resilient section 252, a clamping section 253 and a clamping hole 254 as shown in FIG. 4A. The fixed stage 251 is embedded to a lower end of the top pipe 21 and has a recess 255 concavely directed in a horizontal direction. The resilient section 252 and the clamping section 253 are arranged in the recess 255; and, the clamping section 253, for example, can be a steel ball movable in the recess 255. The clamping section 253 is arranged outside the resilient section 252 and exposes out of the fixed stage 251 due to the resilient force of the resilient section 252. The clamping hole 254 is provided at a top portion of the middle pipe 22 and corresponds to the clamping section 253.

When the top pipe 21 is stretched from the middle pipe 22, the clamping section 253 clamps the clamping hole 254 such that the top pipe 21 is clamped atop the middle pipe 22. If the top pipe 21 is pressed downward, the clamping section 253 is released from the clamping hole 254 and the top pipe 21 is again shrunk into the middle pipe 22.

Figure 4B:
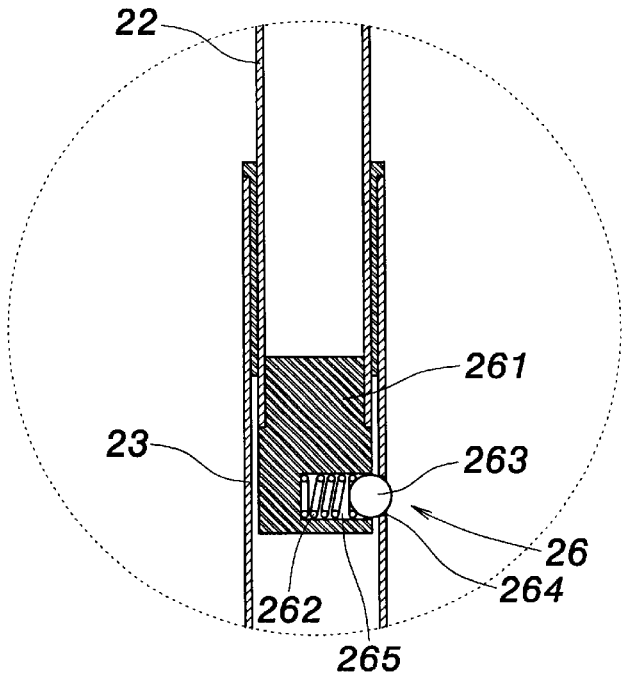
FIG. 4B shows an enlarged view of part B in FIG. 4.

A second clamping unit 26 is provided between the bottom pipe 23 and the middle pipe 22 and comprises a fixed stage 261, a resilient section 262, a clamping section 263 and a clamping hole 264 as shown in FIG. 4B. The fixed stage 261 is embedded to a lower end of the middle pipe 22 and has a recess 265 concavely directed in a horizontal direction. The resilient section 262 and the clamping section 263 are arranged in the recess 265; and, the clamping section 263, for example, can be a steel ball movable in the recess 265. The clamping section 263 is arranged outside the resilient section 262 and exposes out of the fixed stage 261 due to the resilient force of the resilient section 262. The clamping hole 264 is provided at a top portion of the bottom pipe 23 and corresponds to the clamping section 263.

Figure 1:
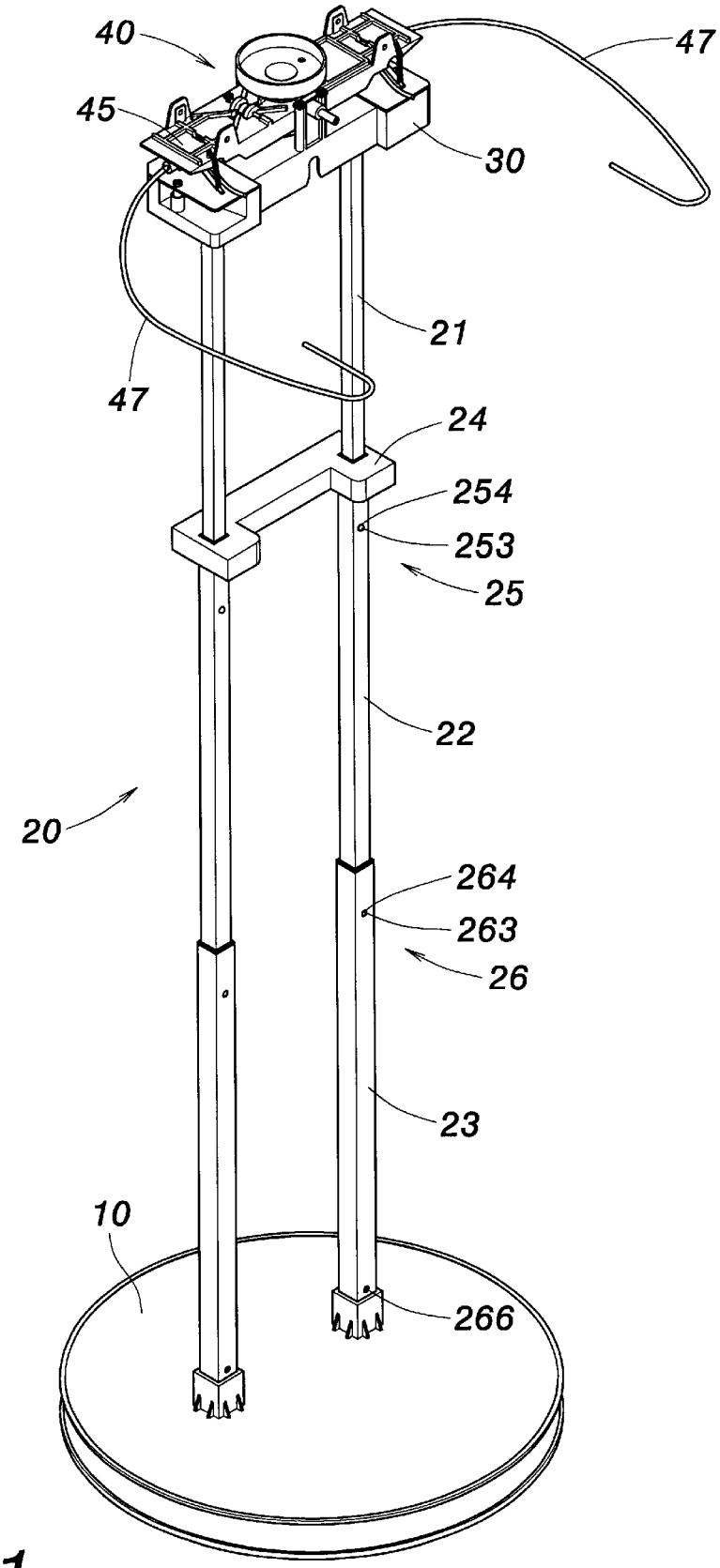
FIG. 1 shows a perspective view of the inventive telescopic doll structure with the figure being removed.
Figure 2:
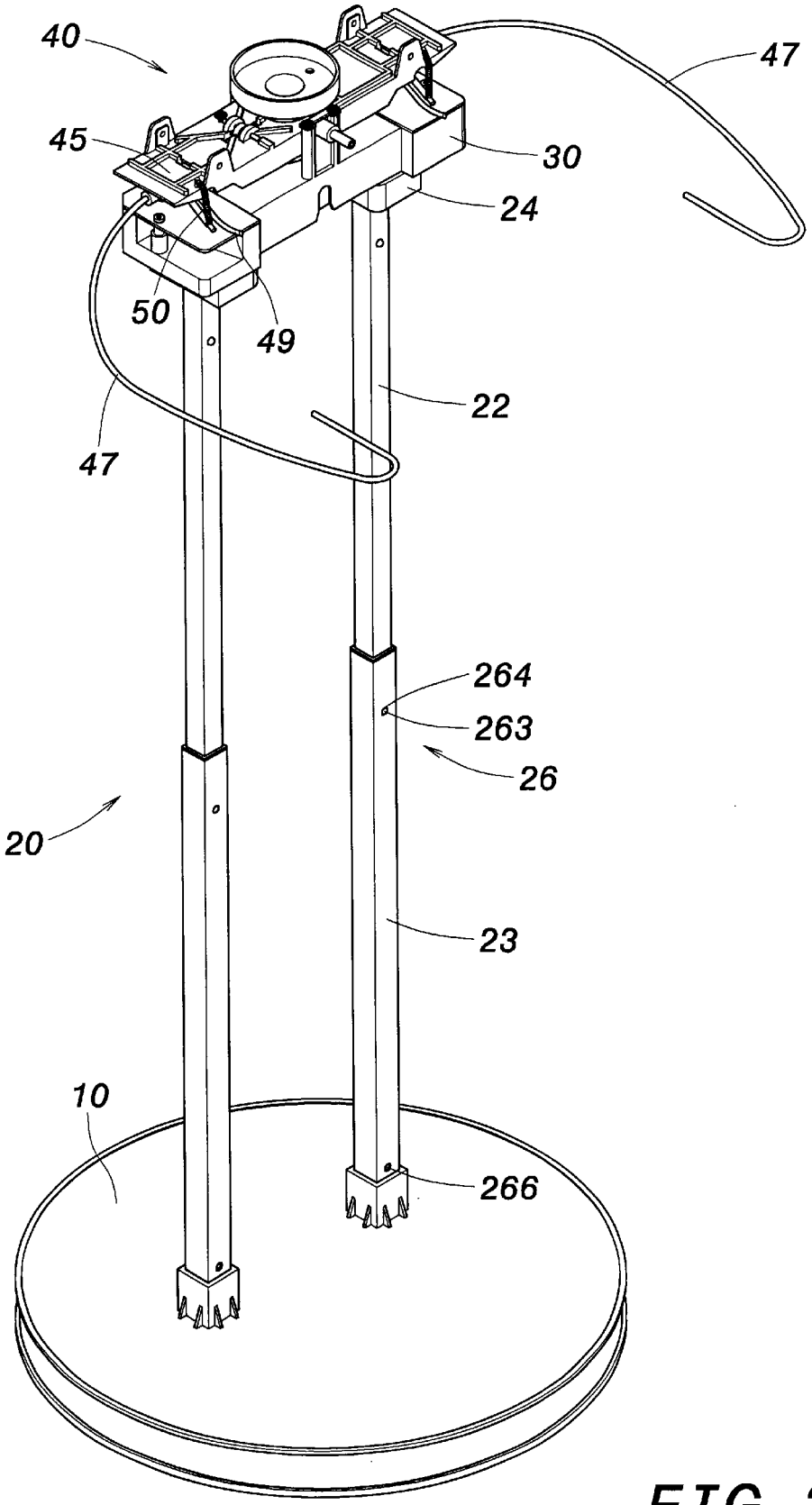
FIG. 2 shows a perspective view of the inventive telescopic doll structure in partially shrunk state with the figure being removed.
Figure 3:
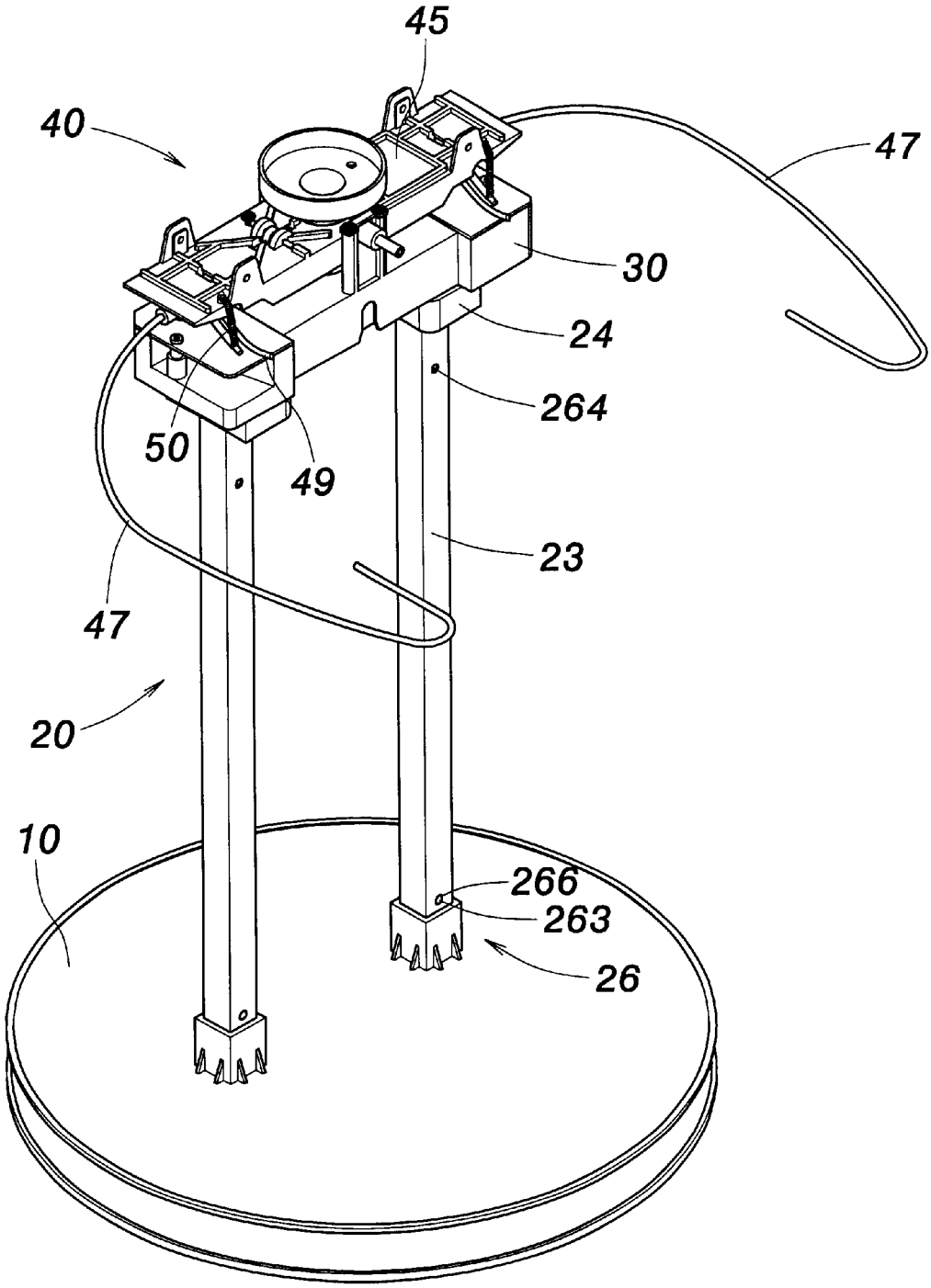
FIG. 3 shows a perspective view of the inventive telescopic doll structure in completely shrunk state with the figure being removed.
Figure 5:
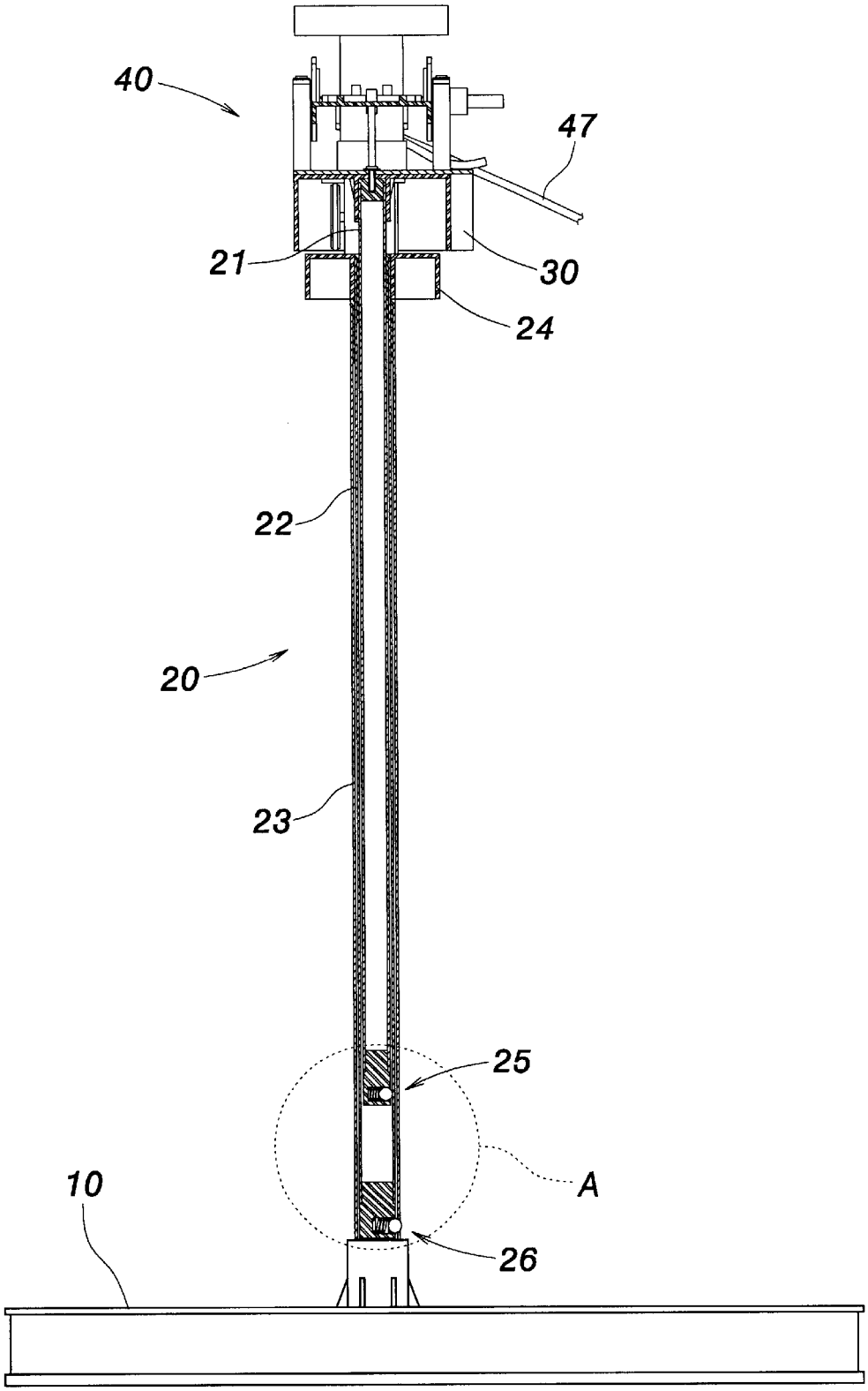
FIG. 5 shows a sectional view of the inventive telescopic doll structure in completely shrunk state with the figure being removed.
Figure 5A:
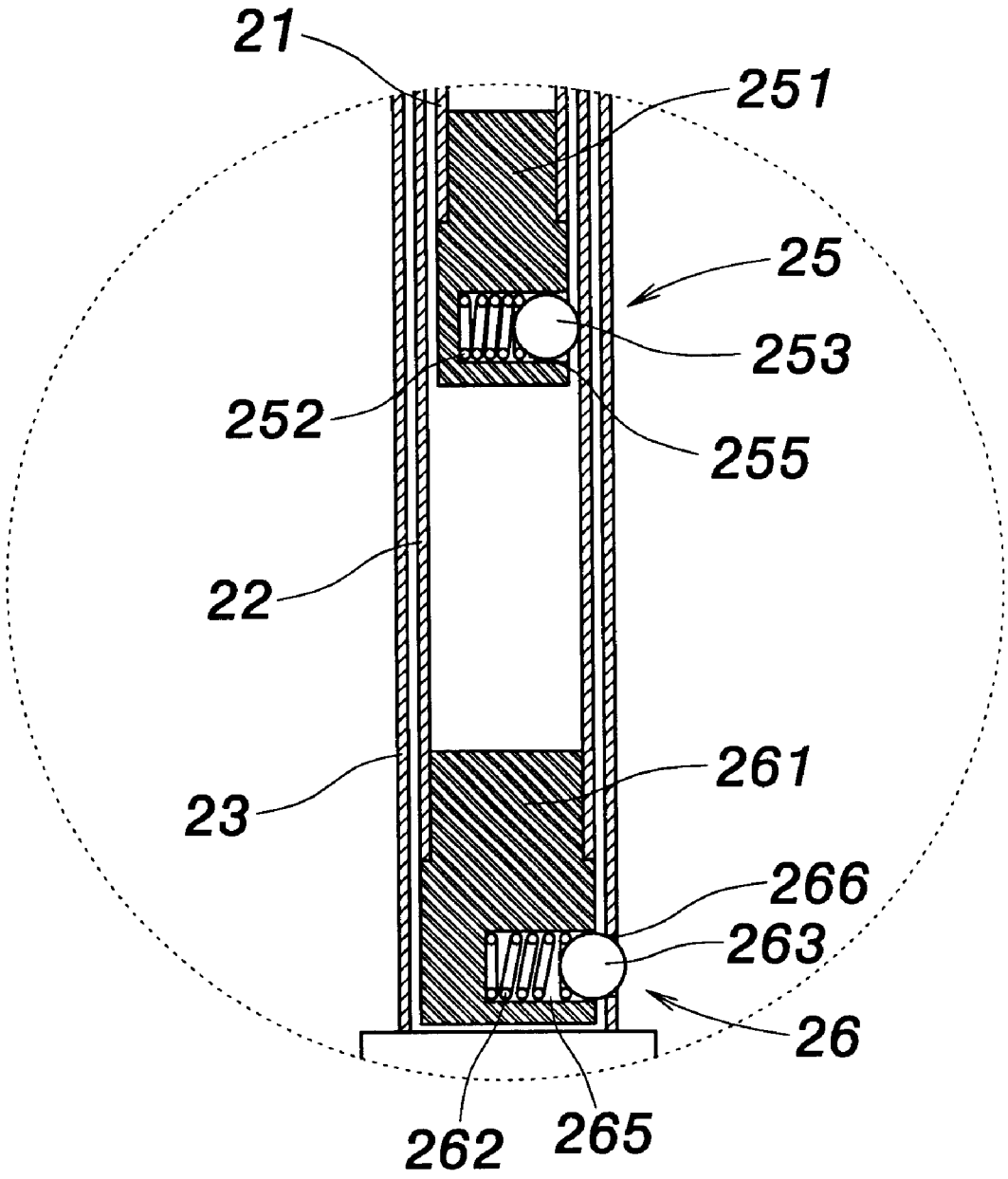
FIG. 5A shows an enlarged view of part A in FIG. 5.

When the middle pipe 22 is stretched from the bottom pipe 23, the clamping section 263 clamps the clamping hole 264 such that the middle pipe 22 is clamped atop the bottom pipe 23. If the middle pipe 22 is pressed downward, the clamping section 263 is released from the clamping hole 264 and the middle pipe 22 is again shrunk into the bottom pipe 23. With reference to FIGS. 3, 5 and 5A, when the middle pipe 22 is shrunk into the bottom pipe 23, the clamping section 263 is clamped to a lower clamping hole 266 on a lower portion of the bottom pipe 23 such that the middle pipe 22 is clamped even in a shrunk state.

With reference to FIGS. 9 and 10, the telescopic doll structure of the present invention is assembled into a FIG. 100 with arbitrary human or animal shape. In the preferred embodiment, the FIG. 100 is a Santa Claus with a bottom thereof fixed to the base and a top thereof fixed to the top stage 30. Therefore, the FIG. 100 covers the telescopic rack 20 and the top stage 30.

When the telescopic rack 20 is in a stretched state, the FIG. 100 is expanded between the base 10 and the top stage 30 as shown in FIG. 9. When the telescopic rack 20 is in a shrunk state, the FIG. 100 is collapsed as shown in FIG. 10. Therefore, the size of the FIG. 100 can be greatly reduced for the convenience of transportation and storage.

Figure 6:
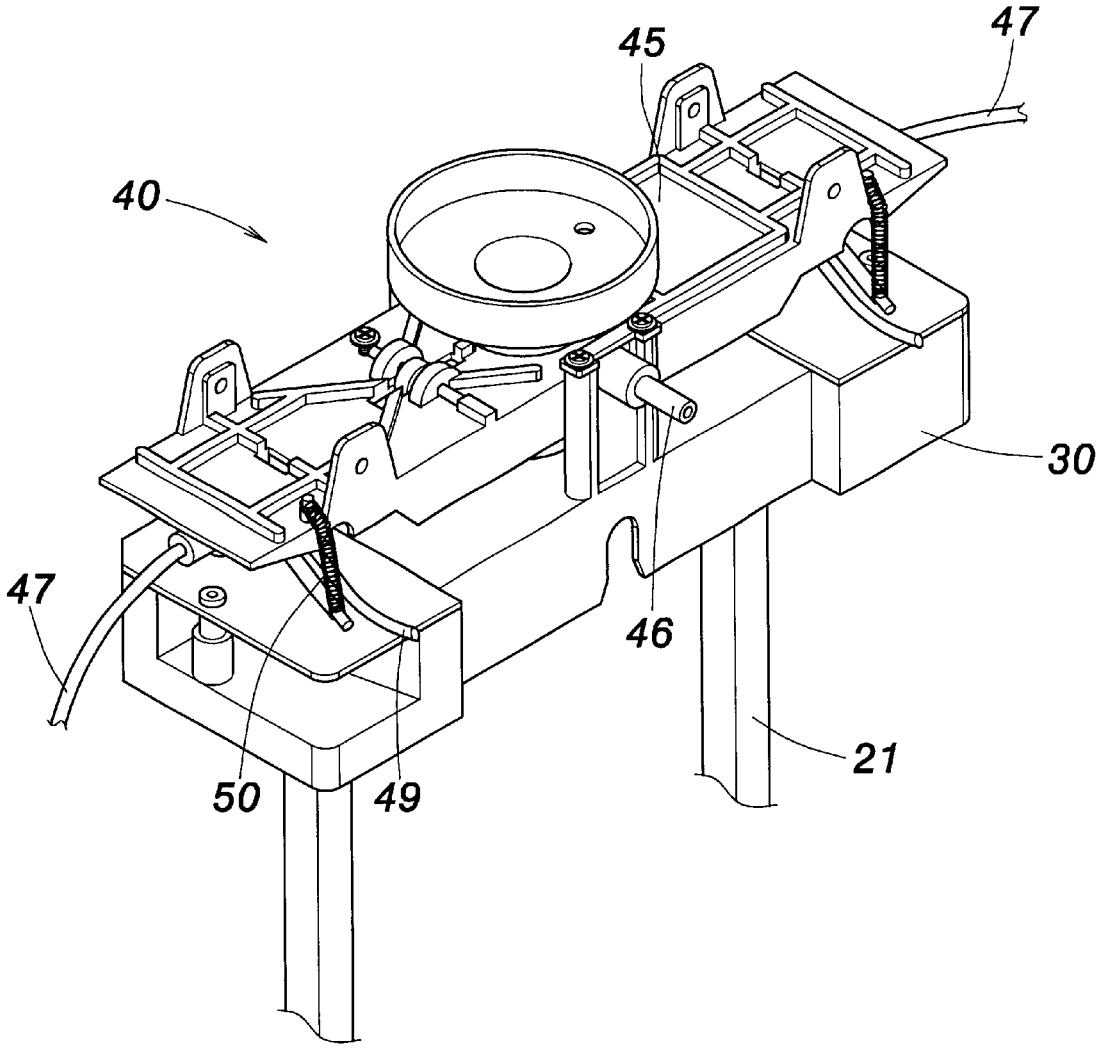
FIG. 6 shows a perspective view of the transmission means.
Figure 7:
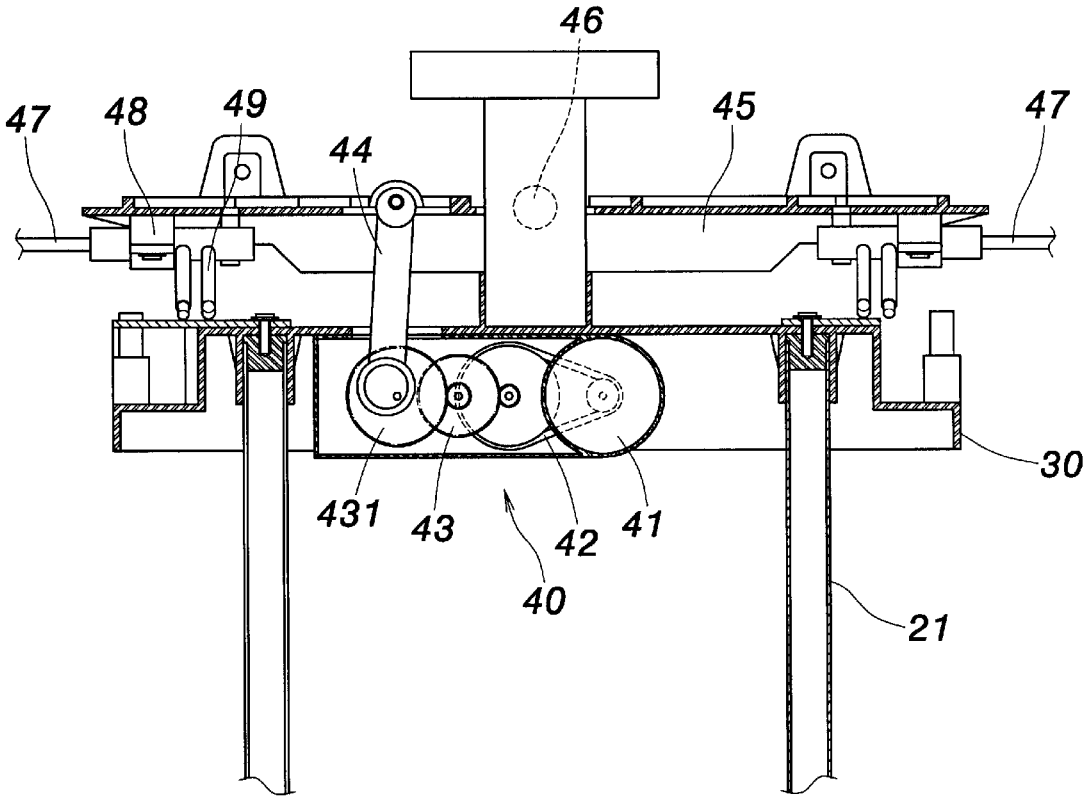
FIG. 7 shows a sectional view of the transmission means.

With reference to FIGS. 6 and 7, a transmission means 40 is provided on the top stage 30 and comprises a motor 41, a belt set 42, a wheel set 43, a link rod 44 and a swing rod 45. The motor 41 is placed in the top stage 30 with its axis connected to the belt set 42. The belt set 42 is linked with the wheel set 43. The link rod 44 is connected eccentrically to one wheel 431 in the wheel set 43 on one end thereof, and the swing rod 45 is pivotally connected to a top of the top stage 30 through a pivotal shaft 46 such that the swing rod 45 seesaws with the pivotal shaft 46 as a pivot. Another end of the link rod 44 is connected to the swing rod 45.

Figure 8:
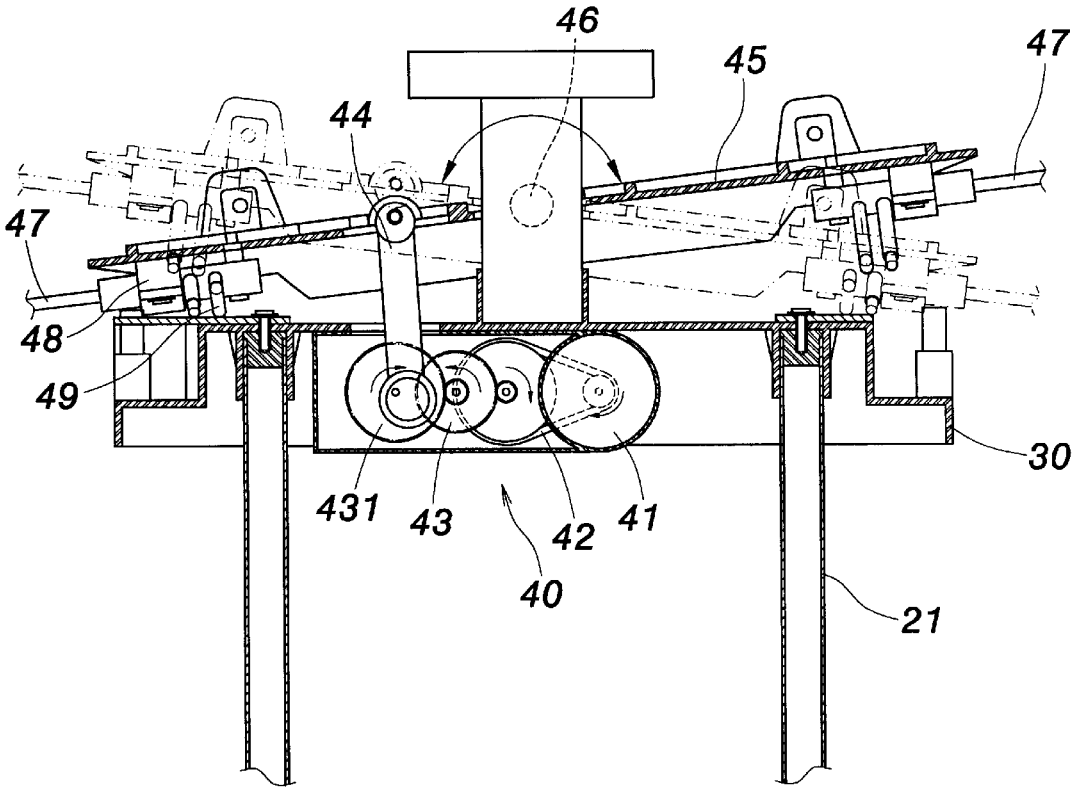
FIG. 8 shows the operation of the transmission means.

When the motor 41 is rotated, the power of the motor 41 is transmitted to the swing rod 45 through the belt set 42, the wheel set 43, and the link rod 44. Therefore, the swing rod 45 is swung alternatively as shown in FIG. 8. The swing rod 45 drives two limbs 47 placed in arms of the FIG. 100, whereby the arms of the FIG. 100 can be swung alternatively by the swing rod 45. When the left arm is raised, the right is down.

One end of the limb 47 is pivotally assembled to a pivotal stage 48 in the swing rod 45 and connected to the top stage 30 through a pusher 49. Moreover, a spring 50 is connected between the limb 47 and one end of the swing rod 45 to resiliently clamp the limbs 47. When the swing rod 45 is swung alternatively, the downward moved end of the swing rod 45 drives the pusher 49 to rotate the limb 47 and raise the limb 47. Therefore, the hand of the FIG. 100 can be raised.

Although the present invention has been described with reference to the preferred embodiment thereof, it will be understood that the invention is not limited to the details thereof. Various substitutions and modifications have been suggested in the foregoing description, and others will occur to those of ordinary skill in the art. Therefore, all such substitutions and modifications are intended to be embraced within the scope of the invention as defined in the appended claims.

I claim:

1. A telescopic doll structure comprising:

a base;

a top stage;

a telescopic rack including a top pair of pipes, a middle pair of pipes and a bottom pair of pipes, said top pair of pipes being retractable within said middle pair of pipes and said middle pair of pipes being retractable within said bottom pair of pipes, the base being fixedly secured to a lower end of said bottom pair of pipes, the top stage being fixedly secured to an upper end of said top pair of pipes, a connection stage being mounted on an upper end of said middle pair of pipes;

at least one clamping unit for releasably locking said top pair of pipes in an extended or retracted position with respect to said middle pair of pipes; and, a figure arranged on the top stage to enclosure an exterior of the telescopic doll structure.

2. The telescopic doll structure as recited in claim 1, wherein said clamping unit includes a fixed stage, a resilient section, a clamping section and a clamping hole, the fixed stage being fixed to a lower end of the top pipe and having a recess, the resilient section and the clamping section being arranged in the recess, the clamping section being arranged outside the resilient section and exposing out of the fixed stage due to a resilient force of the resilient section, the clamping hole being provided at a top portion of the middle pair of pipes and corresponding to the clamping section, whereby the clamping hole can be clamped by the clamping section.

3. The telescopic doll structure as recited in claim 1, wherein a second clamping unit is provided between the bottom pair of pipes and the middle pair of pipes and comprises a fixed stage, a resilient section, a clamping section and a clamping hole, the fixed stage being fixed to a lower end of the middle pair of pipes and having a recess, the resilient section and the clamping section being arranged in the recess, the clamping section being arranged outside the resilient section and exposing out of the fixed stage due to a resilient force of the resilient section, the clamping hole being provided at a top portion of the bottom pipe and corresponding to the clamping section, whereby the clamping hole can be clamped by the clamping section.

4. A telescopic doll structure comprising:

a base;

a top stage;

a telescopic rack is formed by at least three hollow pipes including a top pipe, a middle pipe, and a bottom pipe; the top pipe being retractable into the middle pipe, and the middle pipe being retractable into the bottom pipe, the base being assembled to a lower end of the bottom pipe, and the top stage being assembled to an upper end of the top pipe, a connection stage being provided at an upper end of the middle pipe;

at least one clamping unit to releasably clamp together at least a pair of the hollow pipes when they are extended one relative to another; and, a figure arranged on the top stage to enclose an exterior of the telescopic doll structure.

5. A telescopic doll structure comprising:

a base;

a top stage;

a telescopic rack is formed by at least three hollow pipes including a top pipe, a middle pipe, and a bottom pipe; the top pipe being retractable into the middle pipe, and the middle pipe being retractable into the bottom pipe, the base being assembled to a lower end of the bottom pipe, and the top stage being assembled to an upper end of the top pipe;

at least one first clamping unit to releasably clamp together at least a pair of the hollow pipes when they are extended one relative to another;

a second clamping unit provided between the bottom pipe and the middle pipe, the second clamping unit including a fixed stage, a resilient section, a clamping section and a clamping hole, the fixed stage being fixed to a lower end of the middle pipe and having a recess, the resilient section and the clamping section being arranged in the recess, the clamping section being arranged outside the resilient section and exposing out of the fixed stage due to a resilient force of the resilient section, the clamping hole being provided at a top portion of the bottom pipe and corresponding to the clamping section, whereby the clamping hole can be clamped by the clamping section; and, a figure arranged on the top stage to enclose an exterior of the telescopic doll structure;

a lower clamping hole being provided on a lower portion of the bottom pipe, the clamping section engaging the lower clamping hole when the middle pipe is retracted into the bottom pipe.

6. A telescopic doll structure comprising:

a base;

a top stage;

a telescopic rack is formed by at least two hollow pipes, one pipe being retractable into the other pipe, the base being assembled to one end of one pipe and the top stage being assembled to one end of another pipe;

at least one clamping unit to releasably clamp together at least a pair of the hollow pipes when they are extended one relative to another;

a figure arranged on the top stage to enclose an exterior of the telescopic doll structure; and, a transmission means arranged on the top stage and connected to two limbs.

7. The telescopic doll structure as in claim 6, wherein the transmission means comprises a motor, a belt set, a wheel set, a link rod and a swing rod, the motor placed in the top stage and connected to the belt set, the belt set linked with the wheel set, the link rod connected eccentrically to the wheel set on one end thereof and connected to the swing rod with another end thereof, the swing rod pivotally connected to a top of the top stage.

8. The telescopic doll structure as in claim 7, wherein a limb is pivotally assembled to a pivotal stage in the swing rod, the limb having one end connected to the top stage through a pusher, a spring connected between the limb and one end of the swing rod to resiliently clamp the limbs, when the swing rod is swung alternatively, a downward moved end of the swing rod drives the pusher to rotate one limb and raise one limb.

* * * * *